US005391308A

United States Patent [19]

Despo

[11] Patent Number: 5,391,308

[45] Date of Patent: Feb. 21, 1995

[54] LUBRICANT FOR TRANSPORT OF P.E.T. CONTAINERS

[75] Inventor: Aris D. Despo, Ocean, N.J.

[73] Assignee: Despo Chemicals International, Inc., Perth Amboy, N.J.

[21] Appl. No.: 27,426

[22] Filed: Mar. 8, 1993

[51] Int. Cl.[6] ..... C10M 173/02; C10M 137/02

[52] U.S. Cl. ..... 252/32.5; 252/49.3

[58] Field of Search ..... 252/49.3, 32.5

[56] References Cited

U.S. PATENT DOCUMENTS

| | | | |
|---|---|---|---|
| 4,342,658 | 8/1982 | Tincher et al. | 252/32.5 |
| 4,491,526 | 1/1985 | Deck | 252/32.5 |
| 4,493,780 | 1/1985 | Schwartz et al. | 252/32.5 |
| 4,521,321 | 6/1985 | Anderson et al. | 252/49.3 |
| 4,839,067 | 6/1989 | Jansen | 252/49.3 |
| 4,929,375 | 5/1990 | Rossio et al. | 252/49.3 |
| 5,009,801 | 4/1991 | Wider et al. | 252/49.3 |
| 5,062,979 | 11/1991 | Scharf et al. | 252/49.3 |
| 5,073,280 | 12/1991 | Rossio et al. | 252/49.3 |
| 5,190,679 | 3/1993 | McDonald | 252/49.3 |
| 5,223,162 | 6/1993 | Rossio | 252/49.3 |

OTHER PUBLICATIONS

Ethox Chemicals, Inc. catalog, pp. 1-16, no date.

Avny et al., "Chemical Modification of Polyester Fiber Surfaces" *Journal of Applied Polymer Science*, vol. 32, (Aug. 1986).

Constar International, Certified Lubricant List, (Sept. 1993).

Rohm Haas Specialty Chemicals Hydrotopes catalog, Jan. 1980.

*Primary Examiner*—Ellen M. McAvoy

*Attorney, Agent, or Firm*—Bill C. Giallourakis; Robert G. Weilacher

[57] ABSTRACT

The invention relates to compositions, methods and processes of dilutable aqueous conveyor lubricant concentrates and to the use of the lubricant compositions especially as lubricants for the transport of P.E.T. containers, i.e., containers made of ethylene terephthalate homopolymers, copolymers and mixtures thereof. The aqueous lubricant concentrate compositions (pH 9.0-10.5) contain fatty acid, alkyl phosphate ester and alkyl aryl phosphate esters, which serve the dual role as emulsifying agent and stress crack inhibitor, in the presence of potassium hydroxide as the saponifying agent and in combinations with typical coupling/hydrotrope and chelating agents; and optional inorganic phosphate.

20 Claims, No Drawings

LUBRICANT FOR TRANSPORT OF P.E.T. CONTAINERS

BACKGROUND OF THE INVENTION

1. Field of the Invention

The present invention relates to conveyor lubricants compatible to P.E.T. containers, i.e., containers made of ethylene terephthalate homopolymers, copolymers and mixtures thereof. More particularly, the present invention concerns the methods and use of compositions of emulsifying agents, alkyl phosphate esters, alkyl aryl phosphate esters, fatty acid, potassium hydroxide and optional inorganic phosphate as conveyor lubricants. Even more particularly, the present invention concerns concentrates prepared therefrom, and the methods and use thereof of aqueous dilutable lubricant concentrate solutions for the transport of "P.E.T." containers along conveyor systems.

As is known to those skilled in the art to which the present invention pertains there has been an increasing usage of P.E.T. containers for beverages and other foodstuffs. Such containers are normally filled by passing them through filling and capping stations controlled conveyor systems.

To ensure proper operation of the filling and capping systems it is vital that the conveyor systems be continuously lubricated. Without adequate lubrication, the containers may stack up along the conveyor system and their movement impeded.

Thus, the conveyors are continuously lubricated by applying to the conveyor a lubricant, such as by spraying or the like. Conventional lubricants contain amines, alcohols, potassium hydroxide and other constituents which in various combinations are incompatible with the P.E.T. containers disposed along the conveyor system causing them to eventually crack in transit or storage.

Indeed, it has long been known that exposure by such P.E.T. containers to incompatible lubricants leads to a phenomenon which has been identified as "stress crack failure".

As noted, conventional aqueous-based lubricants containing alcohols, potassium hydroxide and/or amines do not inhibit or prevent stress cracking in P.E.T. containers, but rather promote stress cracking. More particularly, the use of potassium hydroxide as the saponifying agent, in fatty acid lubricants, has been found to contribute to and to promote stress cracking in P.E.T. bottles.

2. Description of Related Art

As disclosed in Wider et al. U.S. Pat. No. 5,009,801, it has been found that stress crack inhibitors, such as sodium xylene sulfonate, do not preclude and overcome the cracking caused by potassium hydroxide. Potassium hydroxide is a widely used component in commercial conveyor lubricants which is plentiful and economical.

Further, U.S. Pat. No. 5,009,801 disclosed the "stress cracking" inhibitor as selected from the group consisting of sodium xylene sulfonate, sodium decyl diphenyl oxide sulfonate, sodium dimethyl naphthalene sulfonate, sodium salt of a linear alkyl benzene sulfonate, and mixtures thereof, and the use of free-base alkyl amine as the saponifying agent. This art has not directed itself to the use of potassium hydroxide as the saponifying agent in the use of lubricant concentrates to be applied to P.E.T. bottles, and/or the use of alternative stress inhibiting agents as described herein.

As disclosed by Rossio in U.S. Pat. No. 5,073,280, which incorporates by reference U.S. Pat. No. 4,929,375, the alkyl aryl sulfonate, per se, is not always essential to the prevention of stress cracking of P.E.T. bottles. Rather, it discloses that a certain class of amines, with a sufficiently large molecular size, will inhibit stress cracking without the presence of the alkyl aryl sulfonate, and additionally smaller molecular weight amines consisting of at least six carbon atoms along with an alkyl aryl sulfonate will inhibit stress cracking of P.E.T. materials. The present invention does not make use of a high molecular weight or smaller molecular weight alkyl amines as the stress cracking inhibitor and saponifying agent as described in Rossio. None of the inventions discussed thus far have pH values which range between 9 to 10.5. The disclosure herein is not anticipated by this patent.

Sharf in U.S. Pat. No. 5,062,979 describes a substantially soap free lubricant containing a neutral (pH 6–8) composition of alkylbenzenesulfonates, partial phosphate esters with alkoxylated aliphatic alcohols, and aliphatic carboxylic acids. Sharf describes a lubricant concentrate usage within a neutral pH range (6–8), which is directed to the prevention of the occurrence of lime soap formation. Sharf's disclosure does not address the problem solved by the disclosure herein nor does Sharf anticipate the full composition or methods described herein.

Anderson teaches in U.S. Pat. No. 521,321 methods of preparing an alkyl phosphate ester conveyor lubricant containing a desired monoalkyl phosphate ester and small amounts of a dialkyl phosphate ester containing C12 to C20 atoms, whereby the composition is neutralized with a base ammonia, ammonium hydroxide or other water-soluble amine. This invention does not address its compatibility for use on P.E.T. containers, stability thereon, or compositions similar to that of the herein disclosure.

Other patents which are distinguishable from this disclosure are U.S. Pat. Nos. 3,583,914; 3,860,521; 4,604,220; 4,769,162; 4,839,067; primarily in as much as none refer to stress crack inhibitors in their claims nor do they set forth compositions which anticipate the disclosure herein.

The invention herein responds to the complaints of beverage bottlers regarding current P.E.T. lubricants in the market place. The current P.E.T. lubricants provide, as a class, inadequate lubrication despite their claims to the contrary, resulting in falling P.E.T. bottles on the conveyor filling and packaging system. This causes undesirable loss of production to the filling and packaging operation. In addition, the current P.E.T. lubricants cause accumulation of foam which creates an undesirable appearance.

Furthermore, in many instances the P.E.T. lubricants are not effective in preventing stress cracking. In other instances, some P.E.T. lubricants use expensive agents to achieve P.E.T. bottle compatibility in lieu of using standard saponifying agents such as potassium hydroxide. Consequently, the present invention solves a different combination of problems than the prior art compositions, allows continued use of potassium hydroxide, and provides novel properties which prevent or inhibit stress cracking in P.E.T. containers.

SUMMARY OF THE INVENTION

The disclosure herein describes a highly dilutable aqueous-based lubricant concentrate which provides methods and solutions not promoting stress crack failure of P.E.T. bottles. It has been found that the compositions of emulsifiers, alkyl phosphates, alkyl aryl phosphates, potassium hydroxide, and optional inorganic phosphates, do not promote stress crack failure when formulated into fatty acid lubricants, whereby the concentrate lubricant pH value is between 9.0 to 10.5. This finding enables the production of dilutable, very economical, easy to produce fatty acid-based aqueous lubricant compositions without any dilatory effects caused by the presence of potassium hydroxide.

In the present invention an aqueous based fatty acid lubricant composition, whereby the pH value is between 9.0 to about 10.5, is prepared from a concentrate comprising:

(a) a long-chain fatty acid,
(b) emulsifying agent for the fatty acid,
(c) stress crack inhibiting agent,
(d) saponifying agent for the fatty acid,
(e) chelant or sequestrant,
(f) coupling agent/hydrotrope,
(g) water, and
(h) optional inorganic phosphate.

The saponifying agent neutralizes the fatty acid which makes it soluble in water. The saponifying agent is selected from a group consisting of alkali metal hydroxides and alkanolamines, although other saponifying agents may be employed. The saponifying agent is, preferably, potassium hydroxide.

The emulsifying agent makes the fatty acid more dispersible in aqueous compositions by forming an emulsion. An emulsion is a dispersion of one liquid in another, the liquids being mutually insoluble or sparingly soluble. With water as one of the liquids, two types of emulsions are possible: oil-in-water (O/W) and water-in-oil (W/O). The term "oil" is used to describe any organic liquid sparingly soluble in water. Herein, in the composition of the present invention, the "oil" is the fatty acid in the aqueous composition. The emulsifying agents are selected from a group consisting of alkyl phosphate ester, alkyl aryl phosphate ester, alkyl aryl ethoxylate, alkyl ethoxylate, and mixtures thereof, although other emulsifying agents may be employed.

The alkyl phosphate ester and alkyl aryl phosphate ester when used in this invention results in substantial reduction in stress cracking, thus functioning as the stress cracking inhibiting agent, as well as the emulsifying agent, in the aqueous lubricant concentrate.

Optimally, the stress cracking inhibiting agent is the free phosphoric acid or potassium salt of the polyoxyethylene decyl ether phosphate, polyoxyethylene nonylphenyl ether phosphate, polyoxyethylene dinonylphenyl ether phosphate, and mixtures thereof.

In use, the concentrate may be diluted with water in concentrations ranging from about 1:100 to about 1:1000, by weight, to form a use solution. The use solution may be applied by manual application, spraying or the like to the exterior of the P.E.T. container.

It is therefore an object of this invention to provide a concentrate, and methods thereof, and its diluted use solutions which uses as its saponifying agent potassium hydroxide to achieve economical production while at the same time overcoming the problem of promoting stress crack failures in P.E.T. containers.

It is also an object of the present invention to provide a method and/or process for lubricating conveyor systems filling P.E.T. bottles or containers which provides a high degree of lubricity while at the same time inhibiting stress crack failures.

It is another object of this invention to use emulsifying agents which serve the dual role as being stress crack failure inhibitors when applied to the exterior surface of P.E.T. containers.

It is yet a further object of this invention to provide a lubricant solution wherein the pH is between 9.0 and 10.5 to significantly enhance lubrication of the P.E.T. conveyor systems.

It is a further object of this invention to provide a P.E.T. lubricant which is compatible based on industry norm standards established by the manufacturers of P.E.T. bottles.

It is still a further object of this invention to provide a lubricant which provides low to moderate foaming at dilutions ranging from 1:100 to 1:1000.

It is still a further object of this invention to provide a P.E.T. compatible lubricant, which when diluted into a use solution, exceeds the foam reduction capabilities of equivalent on-the-market diluted compositions.

These and other objects of this invention will become apparent upon detailed description of the prepared embodiment with the associated examples.

DETAILED DESCRIPTION OF THE PREFERRED EMBODIMENT

The present invention provides composition of highly dilutable aqueous-based fatty acid lubricant concentrates and methods thereof that do not promote stress cracking failure of the P.E.T. container upon application to the exterior of the P.E.T. container by manual, spray or the like.

In a further aspect, hereof, the present invention, generally, provides a fatty-acid based aqueous lubricant concentrate, whereby the pH value of the concentrate is between 9.0–10.5, and a use solution prepared therefrom which incorporates the stress cracking inhibiting agent. The lubricant on the conveyor system provides a sufficient coating on the bottom of the P.E.T. container to inhibit stress cracking.

The lubricant concentrate contemplated herein, generally, comprises:

(a) fatty acid,
(b) emulsifying agent for the fatty acid,
(c) stress cracking inhibiting agent,
(d) saponifying agent for the fatty acid,
(e) chelant or sequestrant,
(f) coupling agent/hydrotrope,
(g) water, and
(h) optionally an inorganic phosphate.

More particularly, the concentrate comprises, by weight:

(a) from about 0.5 to 40 percent of the fatty acid,
(b) from about 0.25 to 25 percent of emulsifying agent,
(c) from about 0.10 to 15 percent of stress crack inhibiting agent,
(d) from about 0.2 to 15 percent of the saponifying agent,
(e) from about 2 to 25 percent of chelant,
(f) from about 1 to 35 percent of coupling agent/hydrotrope agent,
(g) from about 5 to 80 percent of water, and
(h) optionally, from about 0.1 to 12 percent of inorganic phosphate.

Preferably, the concentrate, comprises by weight:

(a) from about 6 to 22 percent of the fatty acid,
(b) from about 0.5 to 12 percent of the emulsifying agent,
(c) from about 0.5 to 9 percent of stress crack inhibiting agent,
(d) from about 2 to 10 percent of the saponifying agent,
(e) from about 6 to 15 percent of the chelant,
(f) from about 3 to 27 percent of the coupling agent/hydrotrope agent,
(g) from about 32 to 70 percent of water, and
(h) optionally, from about 0.2 to 6 percent of inorganic phosphate.

In preparing a lubricant concentrate in accordance herewith, the water is not heated, but is maintained at room temperature. While at room temperature, added to the water is the optional inorganic phosphate, if used; emulsifying agent, stress crack inhibiting agent; and then fatty acid; sequestrant; saponifying agent; and the coupling agent/hydrotrope in the order indicated.

In use, the concentrate is diluted with water in a respective weight ratio from about 1:100 to about 1:1000, and, preferably from about 1:100 to 1:500. The use solution is prepared by admixing the concentrate with water at ambient conditions.

As noted hereinabove, the lubricant concentrate used is a fatty acid-based lubricant. The fatty acid-based lubricant concentrate comprises a long-chain fatty acid consisting of a carboxylic acid having from about 12 to about 22 carbon atoms in the alkyl portion thereof. The fatty acid may be either a saturated or unsaturated fatty acid or a mixture of saturated and unsaturated fatty acids. Preferred fatty acids for this invention are tall oil fatty acids with low rosin content of 0.5 to 0.9 percent by weight and which generally comprise approximately 50 percent by weight oleic acid, 44 percent by weight linoleic acid, 4 percent by weight linolenic acid, and 2.0 percent by weight saturated acid (ACINTOL FA2 tall oil fatty acid). Additional useful fatty acids include coconut fatty acid, lauric acid, palmetic acid, oleic acid, linoleic, linolenic and the like, as well as mixtures thereof. The tall oil fatty acid is generally present in an amount between about 0.5 parts and about 40 parts by weight based on total concentrate weight, and preferably, between about 6 parts and 22 parts by weight based on total concentrate weight.

In this instant the long-chain fatty acid consisting of carboxylic acid having about 12 to 22 carbon atoms in the alkyl portion is treated by a strong base being either sodium hydroxide or potassium hydroxide causing the combination to undergo hydrolysis or saponification.

As stated previously, the emulsifying agent makes the fatty acid more dispersible in aqueous compositions by forming an emulsion. The emulsifying agent of the present invention is selected from the group consisting of polyoxyethylene decyl ether phosphate, polyoxyethylene nonylphenyl ether phosphate, polyoxyethylene dinonylphenyl ether phosphate, ethoxylated nonylphenol, ethoxylated dinonylphenol, ethoxylated tridecyl alcohol, and mixtures thereof.

The embodiment of the present invention consists of an alkyl phosphoric ester, the free acid or potassium salt, and alkyl aryl phosphoric ester, the free acid or potassium salt, and mixtures thereof, providing the desired dual functionality of stress cracking inhibitor and emulsifying agent.

More specifically, the esterified alkyl phosphoric acids or phosphates correspond to the general formula (I):

$$R_1—O—[CH_2CH_2—O]n—PO_3X_2 \quad (I)$$

in which $R_1$ is a linear or branched saturate primary alkyl group, C8 to C12, X is hydrogen and/or an alkali metal, and n is an integer in the range from about 3 to 10.

The esterified alkyl aryl phosphoric acids or phosphates correspond to the general formula (II):

$$R_2R_3—C_6H_3—O—[—CH_2CH_2—O]n—PO_3X_2 \quad (II)$$

in which $R_2$ is linear or branched saturated primary alkyl groups, C8 to C10, $R_3$ is hydrogen, or linear or branched saturated primary alkyl groups, C8 to C10, X is hydrogen and/or an alkali metal, and n is an integer in the range from about 4 to about 10.

In use and as above noted, the stress cracking inhibiting agent is present in an amount of at least 0.1 percent by weight, and preferably 0.5 percent, by weight based on the total weight of the concentrate. Optimally, the stress cracking inhibiting agent is free phosphoric acid or potassium salt of the alkyl phosphate ester and alkyl aryl phosphate ester, and mixtures thereof, and is selected from the group of polyoxyethylene decyl ether phosphate, polyoxyethylene nonylphenyl ether phosphate, polyoxyethylene dinonylphenyl ether phosphate, and mixtures thereof.

It should be noted, and as is apparent that the stress cracking inhibiting agents are, also, emulsifying agents, as well as anionic surfactants. This multi-functionality, thus, contributes to the emulsifying of the fatty acid and the detergency of the lubricant prepared therefrom.

It is preferred to employ as the sequestering agent salts of ethylene diamine tetracetic acid (EDTA). These sequestering agents may be added to the composition in the form of the salts or the acid may be added along with a sufficient amount of metallic hydroxide. Any sequestering agent which will complex calcium and magnesium ions from water may be employed in this invention. Additional suitable sequestering agents are sodium salt of nitrilotriacetic acid (NTA), sodium salt of sodium glucoheptonate, and organic substituted phosphonic acids. When used, and as noted, the sequestering agent is present in an amount of between 2 and 25 parts by weight based on total concentrate weight.

Coupling/hydrotrope agents that may be employed in this invention are glycol ether solvent, glycols, anionic phosphate hydrotropes, amphoteric hydrotrope, the salt of an alkanoic hydrotrope, and mixture thereof. More specifically, the use of such agent in the concentrate lubricant is present in the amount of at least 1 percent to 35 percent, by weight of the total weight of the concentrate. Optimally, the coupling agent is present in the amount of at least 3 percent to 27 percent, by weight of the total weight of the concentrate.

It is also preferred to employ in this invention the optional addition of an inorganic phosphate. This functions as an alkaline buffer and a water softening agent. The inorganic phosphate functions by providing a stable pH buffer of the aqueous lubricant concentrate when admixed with water, wherein the dilution range is between 1:100 and 1:1000, for application of the diluted aqueous lubricant concentrate, wherein the diluted aqueous lubricant is applied to the exterior of the P.E.T.

container. More specifically, the dilution of the aqueous lubricant concentrate, therein, is between 1:100 and 1:500.

In this invention the inorganic phosphate is selected from the group of tetrapotassium pyrophosphate (TKPP), sodium tripolyphosphate and sodium hexametaphosphate. More particularly, the preferred inorganic phosphate is tetrapotassium pyrophosphate.

For a more complete understanding of the present invention reference is made to the following examples. The examples are intended to be illustrative and not limitative, all parts are by weight, absent indication to the contrary.

EXAMPLE 1

A conventional conveyor lubricant concentrate control base was prepared mixing together at 100–120 degrees F., with stirring water, a long chain fatty acid, a glycol, a nonionic surfactant, and sequestrant, potassium hydroxide and alcohol.

The ingredients employed and their respective amounts are shown below. The pH value was 13.2.

| INGREDIENTS (ATTRALUBE-H) | PARTS 100% |
|---|---|
| Tall Oil Fatty Acid | 18.5 |
| Diethylene Glycol | 5.0 |
| Potassium Hydroxide (1) | 10.0 |
| Nonionic Surfactant (2) | 3.0 |
| EDTA (3) | 12.0 |
| Isopropanol | 7.5 |
| Water | 44.0 |

(1) 45 percent solution of KOH
(2) nonylphenol nonionic surfactant, 9 moles EO
(3) 39 percent solution of EDTA sold under the mark of VERSENE by Dow Chemical Corporation.

EXAMPLES 2–11

A series of "modified" conventional conveyor lubricant concentrates were prepared by adding, at room temperature, 3% and 6%, and mixtures thereof, by weight of the candidate stress inhibiting agents to the balance of the premixed control base of Example 1 herein, to make a total of 100% in each case. (Since the control base is premixed, and since it makes up less than 100% of the solutions of these Examples, the percentages of the components of the base as set out in Example 1, are reduced accordingly in the solutions of examples 2–11.)

| | EXAMPLES | | | | | | | | | |
|---|---|---|---|---|---|---|---|---|---|---|
| Ingredients | 2 | 3 | 4 | 5 | 6 | 7 | 8 | 9 | 10 | 11 |
| Control Base (EX1) | 94 | 94 | 97 | 97 | 94 | 97 | 94 | 94 | 94 | 94 |
| Stress Inhib. (1) | 3 | 6 | 3 | — | — | — | — | — | 3 | — |
| Stress Inhib. (2) | 3 | — | — | 3 | 6 | — | 3 | — | — | — |
| Stress Inhib. (3) | — | — | — | — | — | 3 | 3 | 6 | 3 | — |
| SXS (4) | — | — | — | — | — | — | — | — | — | 6 |

(1) polyoxyethylene decyl ether phosphoric acid.
(2) polyoxyethylene nonylphenyl ether phosphoric acid.
(3) polyoxyethylene dinonylphenyl ether phosphoric acid
(4) sodium xylene sulfonate (40% solution)
NOTE: For examples 2–10, the pH values were 10.4–10.5

EXAMPLES 12–21

The conveyor lubricant concentrate, of the present invention, was prepared by mixing together at 80 degrees F., with stirring, water, and an emulsifying/stress cracking inhibiting agent. Thereafter, there was sequentially added to the solution, a long chain fatty acid, a saponifying agent, a sequestrant and a coupling agent-/hydrotrope agent. The pH value was adjusted from 9.1 to about 9.6, by using potassium hydroxide or phosphoric acid, except where otherwise noted.

The ingredients employed, by order of addition, and their, respective, amounts are shown below.

| | EXAMPLES 12–16 | | | | |
|---|---|---|---|---|---|
| | 12 | 13 | 14 | 15 | 16 |
| WATER | 65.50 | 56.50 | 69.50 | 62.00 | 53.75 |
| TKPP (1) | 1.00 | 1.00 | 0.00 | 0.00 | 0.00 |
| POLYOXYETHYLENE NONYLPHENYL ETHER PHOSPHATE, FREE ACID | 1.50 | 3.00 | 3.00 | 2.50 | 5.00 |
| POLYOXYETHYLENE DECYL ETHER PHOSPHATE, FREE ACID | 1.50 | 3.00 | 0.00 | 0.00 | 0.00 |
| TALL OIL FATTY ACID | 10.00 | 14.00 | 8.00 | 10.00 | 14.00 |
| POTASSIUM HYDROXIDE (2) | 4.50 | 5.50 | 4.00 | 4.00 | 5.25 |
| EDTA (3) | 10.00 | 10.00 | 10.00 | 10.00 | 10.00 |
| DIETHYLENE GLYCOL MONOETHYL ETHER | 6.00 | 7.00 | 2.50 | 2.50 | 2.50 |
| DINONYLPHENYL POLYOXYETHLENE ETHER PHOSPHATE | 0.00 | 0.00 | 3.00 | 1.00 | 1.00 |
| AMPHOTERIC HYDROTROPE | 0.00 | 0.00 | 0.00 | 8.00 | 8.50 |
| 2-BUTOXY ETHANOL | 0.00 | 0.00 | 0.00 | 0.00 | 0.00 |
| SODIUM ALKANOATE | 0.00 | 0.00 | 0.00 | 0.00 | 0.00 |
| ADJUSTED TO pH | 9.30 | 9.30 | 9.30 | 9.60 | 9.30 |

Notes:
(1) Tetrapotassium pyrophosphate
(2) 45% solution of potassium hydroxide
(3) 394 solution sold under the mark EDTA by Dow Chemical

| | EXAMPLES 17–21 | | | | |
|---|---|---|---|---|---|
| | 17 | 18 | 19 | 20 | 21 |
| WATER | 55.25 | 53.25 | 66.25 | 53.50 | 54.00 |
| TKPP (1) | 1.00 | 1.00 | 1.00 | 1.00 | 0.00 |
| POLYOXYETHYLENE NONYLPHENYL ETHER PHOSPHATE, FREE ACID | 2.00 | 2.00 | 1.50 | 0.00 | 0.00 |
| POLYOXYETHYLENE DECYL ETHER PHOSPHATE, FREE ACID | 3.00 | 3.00 | 2.00 | 4.50 | 4.50 |
| TALL OIL FATTY ACID | 14.00 | 14.00 | 9.00 | 14.00 | 14.00 |
| POTASSIUM HYDROXIDE (2) | 5.75 | 5.75 | 3.25 | 5.00 | 5.50 |
| EDTA (3) | 10.00 | 10.00 | 10.00 | 10.00 | 10.00 |
| DIETHYLENE GLYCOL MONOETHYL ETHER | 0.00 | 0.00 | 0.00 | 0.00 | 0.00 |
| DINONYLPHENYL POLYOXYETHLENE ETHER PHOSPHATE | 1.00 | 1.00 | 0.50 | 0.00 | 0.00 |
| AMPHOTERIC HYDROTROPE | 3.50 | 2.00 | 1.00 | 3.00 | 3.00 |
| 2-BUTOXY ETHANOL | 4.50 | 4.00 | 3.00 | 4.00 | 4.00 |
| SODIUM ALKANOATE | 0.00 | 4.00 | 2.50 | 5.00 | 5.00 |
| ADJUSTED TO pH | 9.40 | 9.40 | 9.40 | 9.40 | 9.40 |

Notes:
(1) Tetrapotassium pyrophosphate
(2) 45% solution of potassium hydroxide
(3) 39% solution sold under the mark EDTA by Dow Chemical

24 Hour Test

To test the effectiveness of the present invention, more particularly, the diluted conveyor lubricant concentrates, a dilute solution of each of the concentrates, Examples 1 through 21, was prepared by mixing 1 part concentrate with 50 parts of distilled water. (2% solution)

A series of two-liter five-pronged P.E.T. bottles were then pressurized with carbonated water containing 4.9 gas volumes CO2, filled at 37 degrees F. and 33 psi. The bottles were filled and tested for exact CO2 gas volumes by a soft drink processing bottler. Immediately thereafter, the cap was placed on the bottle and tightened by an automatic capper machine, and additionally hand tightened, and allowed to stabilize to ambient temperatures by standing overnight.

The carbonated bottles were then immersed in the prepared dilute use solutions for 24 hours at approximately 100 degrees F. to evaluate the level of stress cracking developed in each solution. The following numerical rating system was developed to quantify the visually observed level of stress cracking on a scale from 0–5, with 5 being total stress crack failure via stress cracking breakthrough to the P.E.T. container, due to explosion. The nominal rating system shown below, although subjective, has been accepted as a standard for rating stress cracking in P.E.T. container by the industry.

| RATING | OBSERVATION |
|---|---|
| 0.0 | No observed stress cracks |
| 0.5 | |
| 1.0 | Minute/shallow stress cracking |
| 1.5 | |
| 2.0 | Moderate shallow stress cracking |
| 2.5 | |
| 3.0 | Moderate deep stress cracking |
| 3.5 | |
| 4.0 | Extensive/deep stress cracking |
| 4.5 | |
| 5.0 | Bottle failure (stress crack breakthrough) |

Note: The above subjective rating system was also used by Johnson Controls, Inc.'s, Plastic Container Division, which conducted similar testing of the applicant's conveyer lubricant formulations and found compatibility between the conveyor line chemicals and P.E.T. containers. Test results were reported on February 12, 1992, and no failure occurred.

After 24 hours, the containers were removed from solution, bottoms of the bottles were rinsed with clean water, drained of their contents, and visually examined according to the above rating system. The dilute use of solution of Example 1, alone, produced bottles that were consistently rated 4.5.

The following table, TABLE 1, sets forth the examples evaluated, and the stress cracking rating results on the P.E.T. bottles after 24 hours in the use solution according to the above outlined procedure.

TABLE 1

| 2% SOLUTION 24 HOURS, 100 DEGREES F. | |
|---|---|
| P.E.T. BOTTLE EXAMPLE NO. | LEVEL OF STRESS CRACKING RATING |
| 1 | 4.5 |
| 2 | 2.5 |
| 3 | 1.0 |
| 4 | 1.5 |
| 5 | 1.0 |
| 6 | 1.5 |
| 7 | 2.0 |
| 8 | 1.5 |
| 9 | 1.0 |
| 10 | 1.0 |
| 11 | 4.0 |
| 12 | 2.0 |
| 13 | 1.0 |
| 14 | 1.0 |
| 15 | 1.0 |

TABLE 1-continued

| 2% SOLUTION 24 HOURS, 100 DEGREES F. | |
|---|---|
| P.E.T. BOTTLE EXAMPLE NO. | LEVEL OF STRESS CRACKING RATING |
| 16 | 1.5 |
| 17 | 0.5 |
| 18 | 0.5 |
| 19 | 0.5 |
| 20 | 0.5 |
| 21 | 0.5 |

The review of the data from Table 1 indicates the diluted conventional conveyor lubricant concentrate, Example 1, rated 4.5, exhibiting extensive, deep stress cracking of the P.E.T. bottles. Furthermore, Example 11 contained the composition of Example 1 with sodium zylene sulfonate (SXS), and was rated at 4.0, exhibiting extensive/deep stress cracking. SXS did not inhibit stress cracking. The diluted "modified" conventional conveyor lubricant concentrates Examples 2–10 consistently rated 1.0 to 2.5, with an average rating of 1.44, and showed a significant improvement over Examples 1 and 11. More particularly it was verified that the alkyl phosphate esters and the alkyl aryl phosphate esters are inhibiting, and therein not promoting stress cracking of P.E.T. containers; thereby establishing the alkyl phosphate esters and the alkyl aryl phosphate esters as valid stress cracking inhibiting agents. The data indicates the best results provided by Examples 12 through 21, with average rating of 0.90.

48 Hour Test

To further test the effectiveness of this invention, a dilute solution of each of the conveyor lubricant concentrates, Examples 1–21, was prepared according to the procedure outlined above for the 24 hours stress cracking evaluation.

The carbonated bottles were them immersed in the prepared use dilutions for 48 hours at approximately 100 degrees F., to evaluate the level of stress cracking developed in each solution. The same numerical rating system to quantify the observed level of stress cracking was employed.

After 48 hours, the bottles were removed from the solution, bottoms were rinsed with clean water, drained of their contents, and visually examined according to the above rating system. As in the 24 hour test, Examples 1 and 11, alone, produced bottles that were consistently rated 4.5.

The following table, TABLE 2, sets forth the Examples evaluated and the stress cracking rating results on the P.E.T. bottles after 48 hours in the use solution according to the above outlined procedure.

TABLE 2

| 2% SOLUTION 48 HOURS, 100 DEGREES F. | |
|---|---|
| P.E.T. BOTTLES EXAMPLE NO. | LEVEL OF STRESS CRACKING RATING |
| 1 | 4.5 |
| 2 | 3.5 |
| 3 | 2.0 |
| 4 | 3.0 |
| 5 | 2.0 |
| 6 | 2.5 |
| 7 | 3.0 |
| 8 | 3.5 |
| 9 | 3.0 |
| 10 | 1.5 |
| 11 | 4.5 |
| 12 | 3.0 |

TABLE 2-continued

| 2% SOLUTION 48 HOURS, 100 DEGREES F. | |
|---|---|
| P.E.T. BOTTLES EXAMPLE NO. | LEVEL OF STRESS CRACKING RATING |
| 13 | 1.5 |
| 14 | 1.5 |
| 15 | 1.5 |
| 16 | 2.5 |
| 17 | 1.0 |
| 18 | 1.0 |
| 19 | 1.0 |
| 20 | 1.0 |
| 21 | 1.0 |

The review of the data from TABLE 2 indicates that the diluted conventional conveyor lubricant Examples 1 and 11 rated 4.5, thereby promoting extensive deep stress cracking of the P.E.T. bottles. The diluted "modified" conventional conveyor lubricant concentrates, Examples 2–10, exhibited significantly less stress cracking than Examples 1 and 11, with an average rating of 2.66, thereby confirming the resulting effect of the addition of the stress cracking inhibiting agent. The data indicates the best results provided by Examples 12–21, with average rating of 1.50.

Concentrate Test

To further test the effectiveness of the present invention, a series of two-liter five-pronged P.E.T. bottles were pressurized with carbonated water containing 4.6 gas volumes CO2, filled at 37 degrees F. and 31 psi. The bottles were filled and tested for exact CO2 gas volumes by a soft drink processing bottler. Immediately thereafter, the cap was placed on the bottle and tightened by an automatic capper machine, and additionally hand tightened, and allowed to stabilize to ambient temperatures by standing overnight.

A series of aqueous conveyor lubricant concentrates, Examples 1–21, were, then, applied, by wiping, between the grooves of the feet of the bottle. After 24 hours, the bottles were evaluated.

The following table, TABLE 3, sets forth the Examples tested and the observed results regarding stress cracking for each of the concentrates.

The same numerical rating system, as previously described, to quantify the observed level of stress cracking was employed. The bottles were visually examined and the results recorded.

TABLE 3

| CONCENTRATE 24 HOURS, 77 DEGREES F. | |
|---|---|
| P.E.T. BOTTLE EXAMPLE NO. | LEVEL OF STRESS CRACKING RATING |
| 1 | 5.0 FAILURE, 4 HRS |
| 2 | 3.5 |
| 3 | 2.5 |
| 4 | 2.5 |
| 5 | 1.0 |
| 6 | 1.0 |
| 7 | 0.5 |
| 8 | 0.0 |
| 9 | 0.0 |
| 10 | 0.5 |
| 11 | 4.5 |
| 12 | 0.0 |
| 13 | 0.5 |
| 14 | 1.0 |
| 15 | 0.5 |
| 16 | 0.5 |
| 17 | 0.0 |
| 18 | 0.0 |
| 19 | 0.0 |

TABLE 3-continued

| CONCENTRATE 24 HOURS, 77 DEGREES F. | |
|---|---|
| P.E.T. BOTTLE EXAMPLE NO. | LEVEL OF STRESS CRACKING RATING |
| 20 | 0.0 |
| 21 | 0.0 |

The review of the data from Table 3 indicates the conventional conveyor lubricant concentrate Example 1 consistently exhibited extensive, deep stress cracking of the P.E.T. bottles; likewise, so did Example 11 which contained sodium xylene sulfonate (SXS). More particularly, the conventional conveyor lubricant concentrate Example 1 caused total stress crack failure of the bottle. The "modified" conventional conveyor lubricant concentrates, Examples 2–10, consistently rated 0.0 to 3.5, with an average rating of 1.27, showing a significant improvement over Examples 1 and 11, and more particularly, no stress cracking failure, as in Example 1. The data indicates the best results provided by Examples 12 through 21, with average rating of 0.25. This test confirmed that the stress crack inhibiting properties of SXS were negligible and, hence, was discarded as an ingredient for stress cracking inhibitor.

Furthermore, the inventor has conducted 14 day tests of similar solutions and 30 day tests in which no stress crack failure occurred.

The foregoing examples and methods have been described in the foregoing specification for the purpose of illustration. Although the above lubricant with its stress cracking inhibiting ingredients has been described in terms of application to P.E.T. containers, the invention can be used with regard to other plastic containers such as polybutylene terephthalate. Furthermore, many other modifications will naturally suggest themselves to those skilled in the art based on this disclosure. These are to be comprehended as being within the scope of this invention.

Accordingly, it is intended that the present invention embrace all alternatives, modifications, and variations as fall within the spirit and broad scope of the appended claims.

What is claimed is:

1. An aqueous conveyor lubricant concentrate capable of being diluted with water for applying to the exterior of P.E.T. containers being transported along a conveyor system comprising:

(a) a long chain fatty acid;
(b) emulsifying agent;
(c) stress crack inhibiting agent; which is an alkyl aryl phosphate ester or an alkyl phosphate ester;
(d) saponifying agent;
(e) sequestrant;
(f) coupling agent/hydrotope;
(g) water; and
(h) optionally, an inorganic phosphate wherein the pH of said concentrate is in the range of 9 to 10.5.

2. The aqueous conveyor lubricant concentrate of claim 1 wherein the saponifying agent is an alkali metal hydroxide.

3. The aqueous conveyor lubricant concentrate of claim 1 wherein the stress crack inhibiting agent is an alkyl aryl phosphate ester having between eight and ten carbon atoms in the alkyl portion.

4. The aqueous conveyor lubricant concentrate of claim 1 wherein the stress crack inhibiting agent is an alkyl phosphate ester.

5. The aqueous conveyor lubricant of claim 1 wherein the stress crack inhibitor, which also serves as an emulsifying agent, is selected from a group consisting essentially of polyoxyethylene decyl ether phosphate, polyoxyethylene nonylphenyl ether phosphate, polyoxyethelyene dinonylphenyl ether phosphate, and mixtures thereof.

6. The aqueous conveyor lubricant concentrate of claim 1 wherein the emulsifying agents are the alkyl phosphate ester, alkyl aryl phosphate ester, alkyl aryl ethoxylate, alkyl ethoxylate and mixtures thereof.

7. The aqueous conveyor lubricant of claim 1 wherein the emulsifying agents are selected from a group consisting essentially of polyoxyethylene decyl ether phosphate, polyoxyethylene nonylphenyl ether phosphate, polyoxyethylene dinonylphenyl ether phosphate, ethoxylated nonylphenol, ethoxylated dinonylphenol, and ethoxylated tridecyl alcohol, and mixtures thereof.

8. The aqueous conveyor lubricant of claim 2 wherein the alkali metal hydroxide is potassium hydroxide.

9. The aqueous conveyor lubricant of claim 1 wherein the concentrate comprises:

(a) from about 0.25 to 25 percent, by weight of the emulsifying agent;
(b) from about 0.10 to 15 percent by weight of the stress cracking inhibitor;
(c) from about 0.5 to 40 percent, by weight, of the long chain fatty acid;
(d) from about 0.2 to 15 percent, by weight, of the saponifying agent;
(e) from about 2 to 25 percent, by weight, of the sequestrant;
(f) from about 1 to 35 percent, by weight, of the coupling/hydrotrope agent;
(g) from about 5 to 80 percent, by weight, of the water;
(h) optionally, from about 0.10 to 12 percent, by weight, of the inorganic phosphate.

10. The aqueous lubricant concentrate of claim 9 wherein the concentrate has the pH between 9.0 and 10.5.

11. A method of inhibiting stress cracking in P.E.T. containers comprising the step of applying a dilute aqueous fatty acid soap based lubricant use solution to the exterior of the P.E.T. container, wherein the pH of the concentrate from which the use solution is made is in the range of 9 to 10.5, the use solution comprising a stress cracking inhibitor which is a compound of one or more of the alkyl aryl phosphate ester and alkyl phosphate ester singly or in combination.

12. The method of claim 11, wherein the stress cracking inhibitor, alkyl aryl phosphoric ester or alkyl phosphate ester, which also serves as emulsifying agent, is selected from the group consisting of polyoxyethylene decyl ether phosphate, polyoxyethylene nonylphenyl ether phosphate, polyoxyethylene dinonylphenyl ether phosphate, and mixtures thereof.

13. A method of inhibiting stress cracking on a poly(ethylene terephthalate) article, comprising the step of applying to said article a soap based composition consisting essentially of a free phosphoric acid or potassium salt of an alkyl aryl phosphate ester in the presence of an alkali metal hydroxide.

14. The method of claim 13, wherein the said alkyl aryl phosphate esters are selected from the group consisting of polyoxyethylene nonylphenyl ether phosphate, polyoxyethylene dinonylphenyl ether phosphate and mixtures thereof.

15. The method of claim 13 wherein the said alkyl aryl ether phosphates are of the formula:

$$R_2R_3—C_6H_3—O[—CH_2CH_2—O]n—P\ O_3\ X_2 \quad (II)$$

in which $R_2$ is linear or branched saturated primary alkyl groups, containing 8 to 12 carbon atoms, $R_3$ is hydrogen, or linear or branched saturated primary alkyl groups containing 8 to 10 carbon atoms, X is hydrogen and/or an alkali metal, and n is an integer in the range from 4 to about 10.

16. A method of inhibiting stress cracking on a poly(ethylene terephalate) article comprising the step of applying to said article a soap based composition consisting essentially of a free phosphoric acid or potassium salt of an alkyl phosphate ester in the presence of an alkali metal hydroxide.

17. The method of claim 16, wherein the said alkyl phosphate ester is the polyoxyethylene decyl ether phosphate.

18. The method of claim 16 wherein the said alkyl ether phosphates are of the formula:

$$R_1—O—[CH_2CH_2—O]n—PO_3X_2 \quad (I)$$

in which $R_1$ is a linear or branched saturate primary alkyl group, C8 to C12, X is hydrogen and/or an alkali metal, and n is an integer in the range from about 3 to 10.

19. An aqueous conveyor lubricant concentrate composition for P.E.T. containers moving on a conveyor system comprising:

(a) Water present in the amount between 32 to 70 percent, by weight, based on the total concentrate weight; and
(b) A fatty acid mixture of tall oil fatty acid present in an amount between 6 to 22 percent by weight of the total concentrate; and
(c) As stress crack inhibitors, polyoxyethylene dinonylphenyl ether phosphate, polyoxyethylene decyl ether phosphate and polyoxyethylene nonylphenyl ether phosphate, present in an amount between 0.5 to 9.0 percent, by weight, of the total concentrate; and
(d) As emulsifiers, polyoxyethylene decyl ether phosphate, polyoxyethylene dinonylphenyl ether phosphate, polyoxyethylene nonylphenyl ether phosphate, ethoxylated nonylphenol, ethoxylated dinonylphenol, and ethoxylated tridecyl alcohol, present in an amount between 0.5 to 12 percent, by weight, of the total concentrate; and
(e) Potassium hydroxide present in the amount of 2 to 10 percent, by weight, based on the total concentrate weight; and
(f) Sequestrant agent present in the amount between 6 to 15 based on the total concentrate weight; and
(g) Coupling/hydrotrope agent present in the amount between 3 to 27 percent based upon the total concentrate weight; and
(h) Optional inorganic phosphate present in the amount between 0.2 to 6 percent of the total concentrate weight.

20. In a process comprising lubricating continuous conveyors of P.E.T. vessels for containing food or beverages, the improvement wherein the lubricant concentrate used is an aqueous lubricant composition having a pH value in the range from about 9.0 to 10.5, and comprises 32 to 70 percent of water by weight of the total composition and:

(a) From about 0.5 to 9.0 percent by weight of the total composition comprising at least one compound of the formulas (I) or (II):

$$R_1—O—[CH_2CH_2—O]n—PO_3X_2 \quad (I)$$

in which $R_1$ is a linear or branched saturate primary alkyl group, C8 to C12, X is hydrogen and/or an alkali metal, and n is an integer in the range from about 3 to 10:

$$R_2R_3—C_6H_3—O[—CH_2CH_2—O]n—P\ O_3\ X_2 \quad (II)$$

in which $R_2$ is linear or branched saturated primary alkyl groups, containing 8 to 12 carbon atoms, $R_3$ is hydrogen, or linear or branched saturated primary alkyl groups containing 8 to 10 carbon atoms, X is hydrogen and/or an alkali metal, and n is an integer in the range from 4 to about 10; and (b) From about 6 to 22 percent, by weight, of the total composition of molecules selected from the group of a long-chain fatty acid consisting of carboxylic acid having from about 12 to 22 carbon atoms in the alkyl portion thereof; and (c) From about 0.5 to 12 percent of the emulsifying agent by weight of total composition; and (d) From about 2 to 10 percent, of the saponifying agent by weight of total composition; and, optionally, (e) Conventional sequestering agent, coupling/hydrotrope agent, optional inorganic phosphate, or mixtures thereof.

* * * * *